US006788216B2

(12) United States Patent
Chen

(10) Patent No.: US 6,788,216 B2
(45) Date of Patent: Sep. 7, 2004

(54) ACCESSORY ALARM DEVICE OF COMPUTER LOCK

(76) Inventor: Chung-Yang M. Chen, 3F, No. 2, Lane 497, Chung-Cheng Rd., Hsintien City, Taipei County (TW)

( * ) Notice: Subject to any disclaimer, the term of this patent is extended or adjusted under 35 U.S.C. 154(b) by 7 days.

(21) Appl. No.: 10/245,323

(22) Filed: Sep. 18, 2002

(65) Prior Publication Data

US 2004/0051647 A1 Mar. 18, 2004

(51) Int. Cl.[7] ..... G08B 13/14; G08B 13/00
(52) U.S. Cl. ..... 340/693.5; 340/566; 340/571; 340/572.9; 70/57.1; 70/58
(58) Field of Search ..... 340/693.5, 542, 340/566, 571; 70/57.1, 58, 168, 169; 235/128, 130 R

(56) References Cited

U.S. PATENT DOCUMENTS 5,926,092 A * 7/1999 Kim ..... 340/571
6,182,481 B1 * 2/2001 Nagy ..... 70/58

* cited by examiner

*Primary Examiner*—Jeffery Hofsass
*Assistant Examiner*—Jennifer A Stone
(74) *Attorney, Agent, or Firm*—Troxell Law Office PLLC

(57) ABSTRACT

Accessory alarm device of computer lock, including a housing in which an alarm system is installed and a connecting plate extending from the housing. The connecting plate is formed with at least one perforation adapted to a locking bolt of a computer lock. The locking bolt of the computer lock can be passed through the perforation and inserted into a socket of the computer to lock the alarm device on the computer. The alarm device is controllably set in a standby state. In case the computer is unauthorizedly moved, the shake will trigger the alarm device to emit alarm sound so as to achieve a burglarproof effect.

3 Claims, 6 Drawing Sheets

ACCESSORY ALARM DEVICE OF COMPUTER LOCK

BACKGROUND OF THE INVENTION

The present invention is related to an accessory alarm device capable of achieving a burglarproof effect for a computer. The alarm device includes a housing in which an alarm system is installed and a connecting plate extending from the housing. The connecting plate is formed with a perforation. A locking bolt of a computer lock can be passed through the perforation and inserted into a socket of the computer to lock the alarm device on the computer. In case the computer is unauthorizedly moved or shaken, the alarm device is immediately triggered to emit alarm sound so as to prevent the computer from being stolen.

Notebook-type computers have been widely used in various fields. Such notebook-type computers are easily portable and quite expensive. Therefore, it often takes place that a notebook-type computer is stolen by a thief. In order to prevent the notebook-type computer from being stolen, the housing of the computer is formed with a specified locking hole. The locking bolt of a cooperative computer lock can be inserted and latched in the locking hole to lock the computer with a stationary article. Therefore, an unauthorized person cannot take away the computer. However, such computer lock has poor quality. As a result, a thief can easily break the lock or a connecting cable to steal the computer. Therefore, it is necessary to provide a more effective burglarproof alarm device for preventing the computer from being stolen.

SUMMARY OF THE INVENTION

It is therefore a primary object of the present invention to provide an accessory alarm device of computer lock. The alarm device includes a housing in which an alarm system is installed and a connecting plate extending from the housing. The connecting plate is formed with a perforation. When locking the computer, the locking bolt of the computer lock can be passed through the perforation and inserted into a socket of the computer to also lock the alarm device on the computer. In case the computer is unauthorizedly moved or shaken, the alarm device can immediately sense the alien shake and emit alarm sound so as to prevent the computer from being stolen.

The present invention can be best understood through the following description and accompanying drawings wherein:

DETAILED DESCRIPTION OF THE PREFERRED EMBODIMENTS

Figure 1:
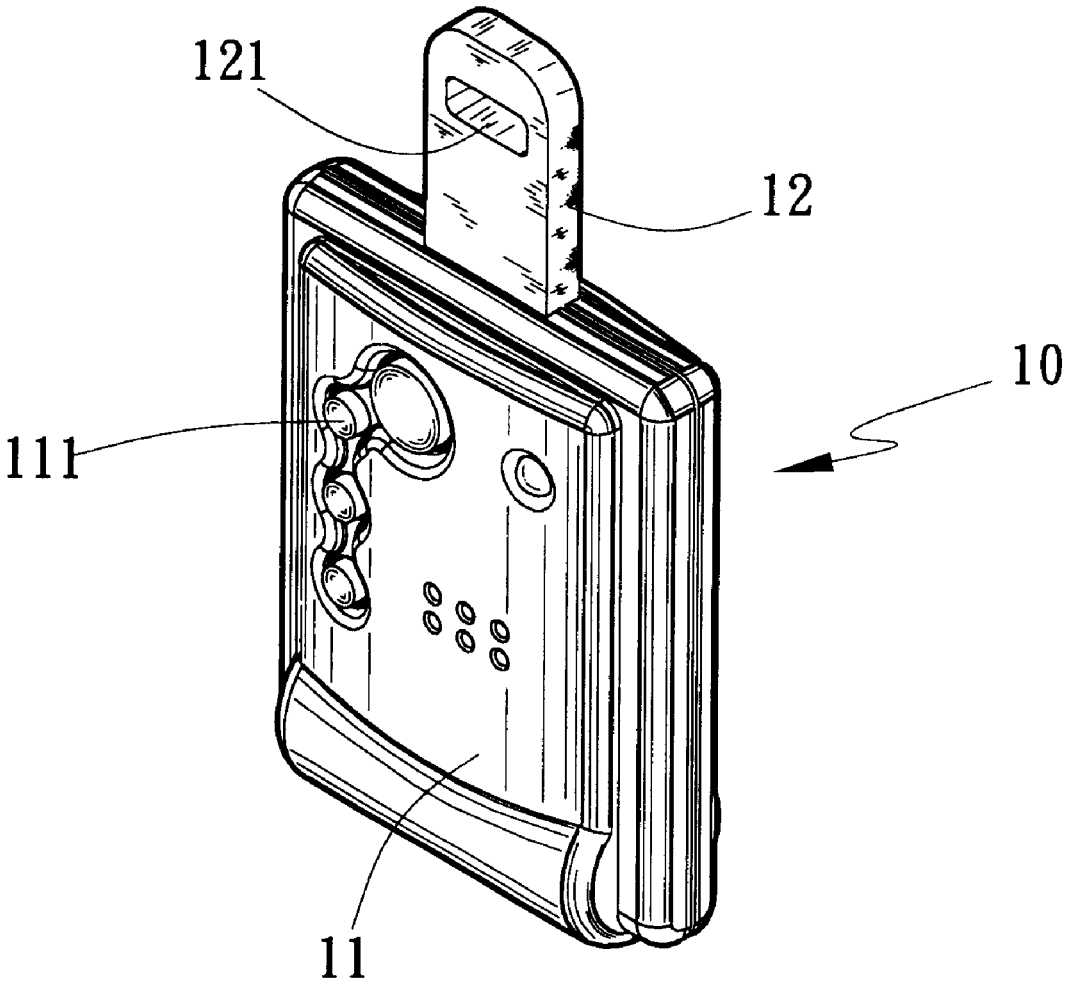
FIG. 1 is a perspective view of an embodiment of the present invention, in which the connecting plate is fixed.
Figure 2:
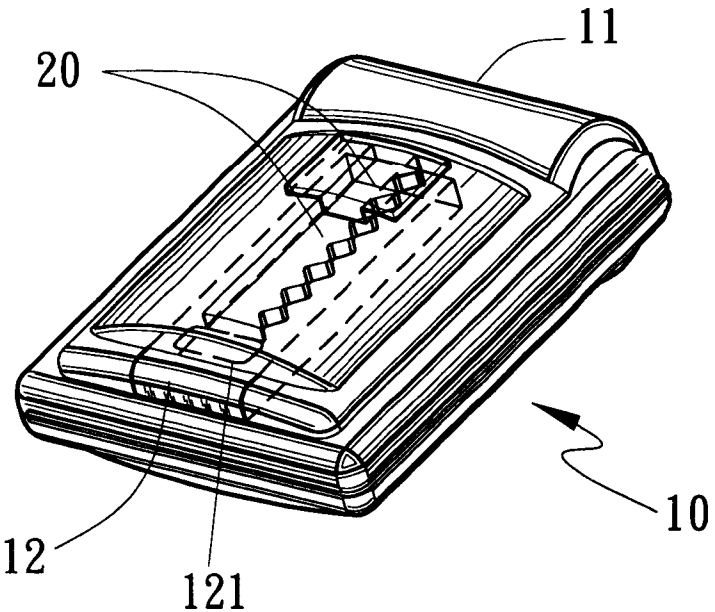
FIG. 2 is a perspective view of another embodiment of the present invention, in which the connecting plate is retractable/extensible.
Figure 3:
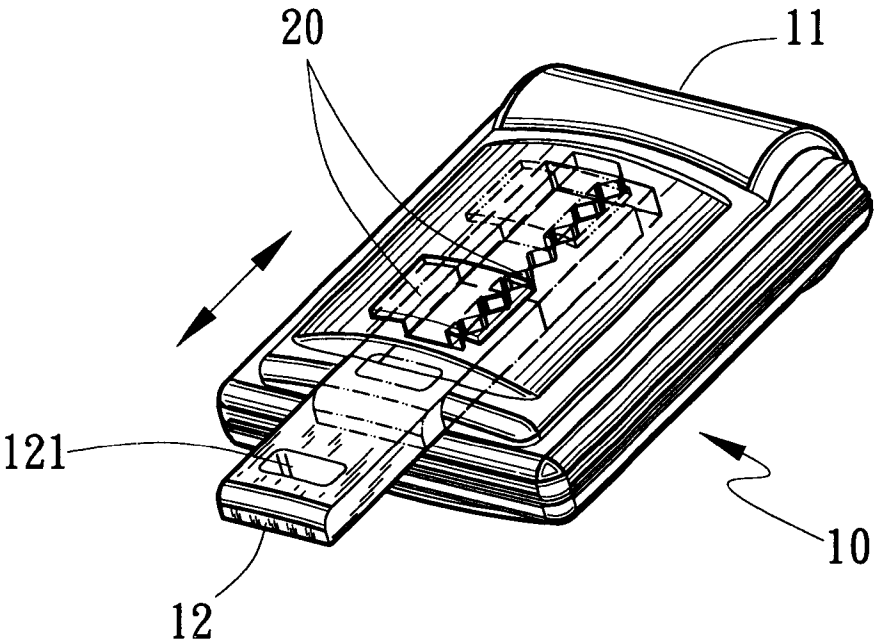
FIG. 3 shows that the connecting plate of FIG. 2 is extended out.
Figure 5:
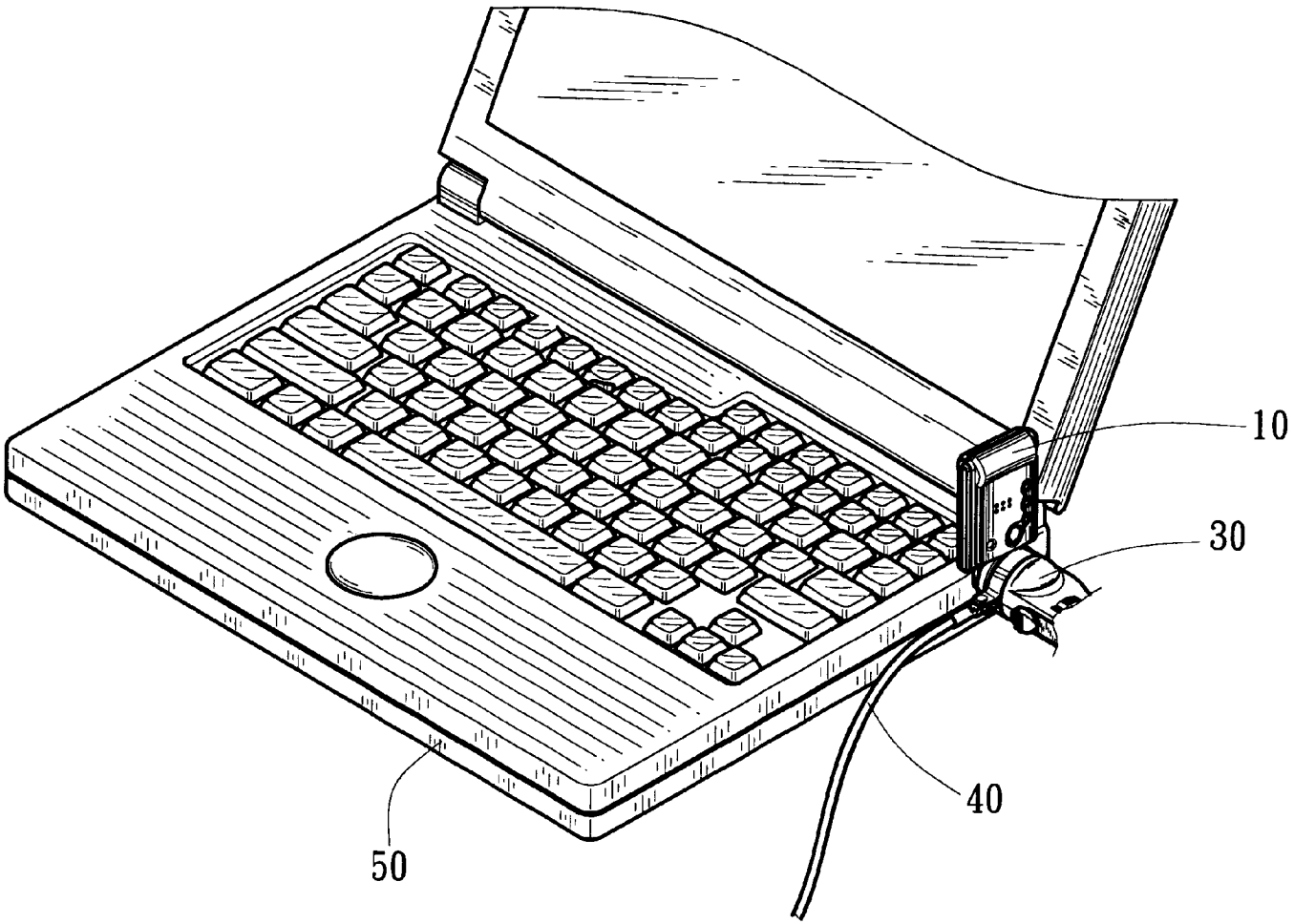
FIG. 5 shows an application of the present invention.
Figure 6:
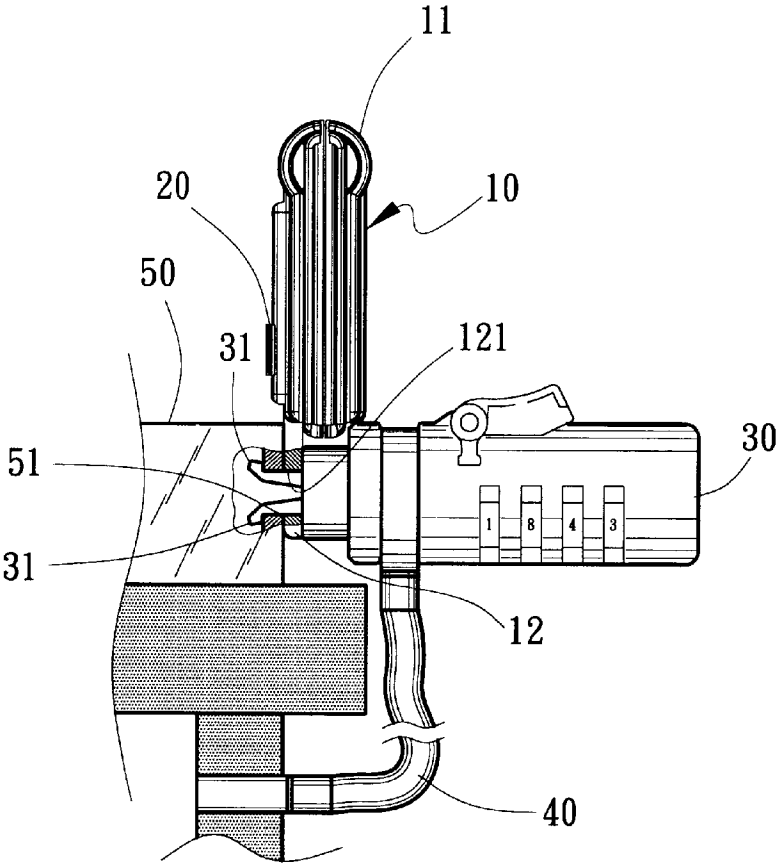
FIG. 6 is a sectional view of a part of FIG. 5.
Figure 7:
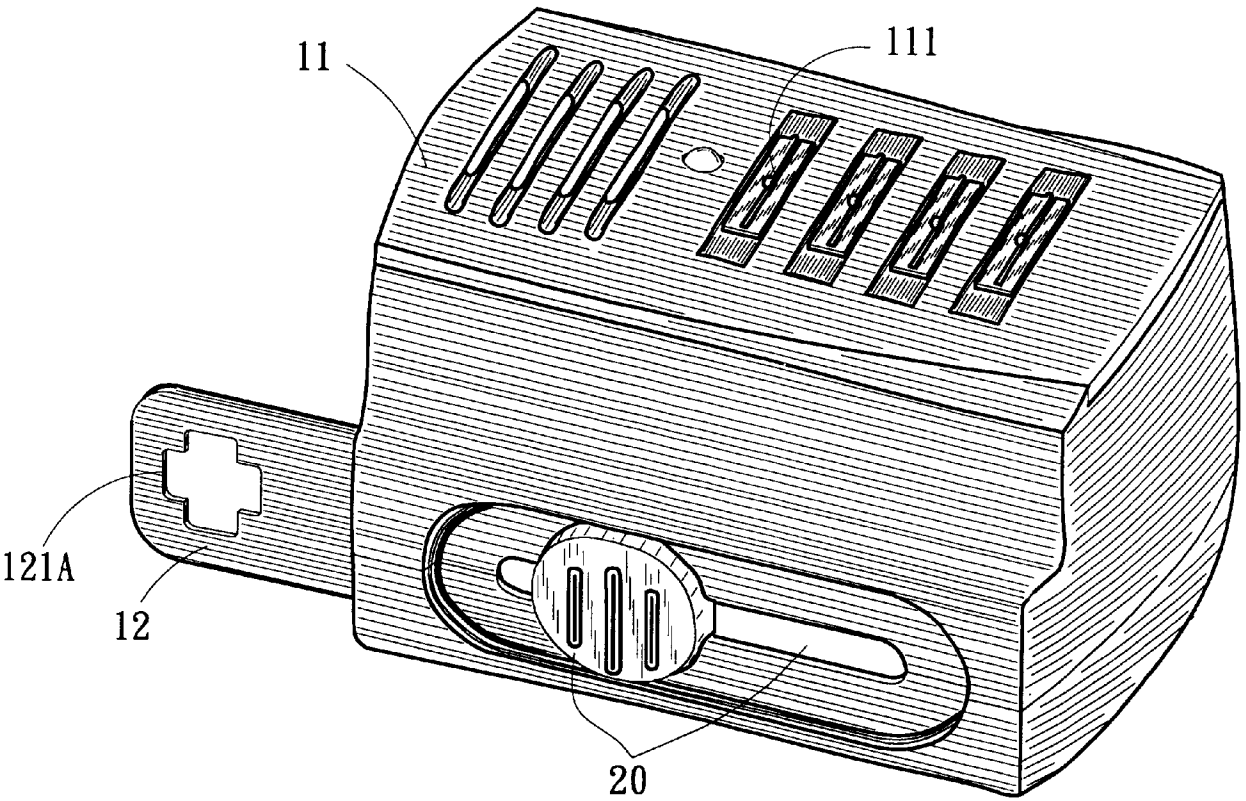
FIG. 7 shows still another embodiment of the present invention.

Please refer to FIG. 1. The alarm device 10 of the present invention includes a housing 11 and a connecting plate 12 disposed on the housing 11. An alarm system is installed in the housing 11, including a sensing unit and an alarm sounding unit. A press key 111 is provided on the housing 11 for turning on/off the alarm device 10. The connecting plate 12 is formed with a slot 121 adapted to a computer locking bolt. FIGS. 5 and 6 show an application of the present invention. FIG. 7 shows a cross-shaped perforation 121A which can be more elastically used. The locking bolt 31 of a computer lock 30 can be passed through the slot 121 and then the rear end of the locking bolt 31 is inserted into a specified locking hole 51 of the computer body 50. Therefore, the alarm device 10 can be locked on the computer 50. A cable 40 is further connected with the computer lock 30 for fixing the computer with a certain stationary article. In addition, FIGS. 2 and 3 show another embodiment of the present invention can be more easily used and carried. In this embodiment, a retractable/extensible sliding mechanism 20 is disposed between the connecting plate 12 and the housing 11. When not used, the retractable/extensible sliding mechanism 20 is pushed to retract the connecting plate 12 into the housing 11. This reduces the length of the device and the room occupied by the device (with reference to FIG. 2 or FIG. 4). Reversely, in use, a user can push and extend the retractable/extensible sliding mechanism 20 to expose the slot 121 of the connecting plate 12 to outer side (with reference to FIG. 3 or FIG. 4). Under such circumstance, the locking bolt 31 of the computer lock 30 can be passed through the slot 121 and inserted into a socket 51 of the computer 50 lock the device with the computer.

Figure 4:
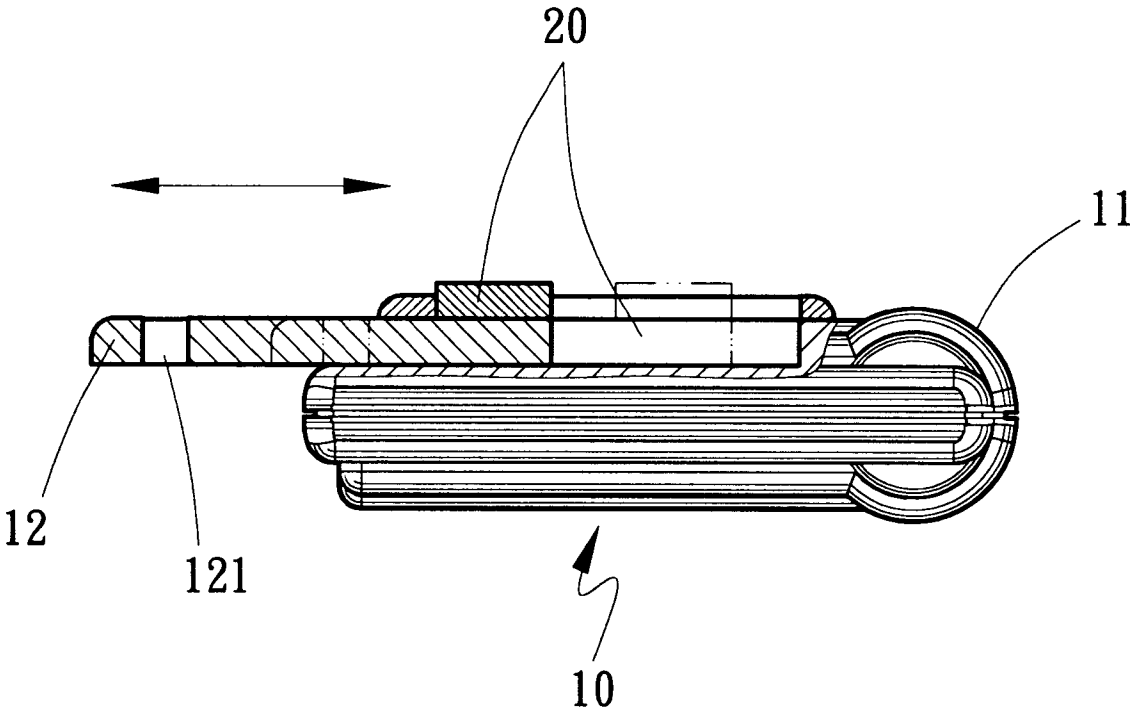
FIG. 4 is a cross-sectional view according to FIG. 3.

Referring to FIG. 4, the alarm device 10 is combined and locked with the computer 50 and turned on. In case the computer 50 is unauthorizedly moved, the shake or alien message will trigger the alarm device 10 to emit alarm sound. The alarm device and the original computer lock cooperate with each other to achieve a better burglarproof effect.

The above embodiments are only used to illustrate the present invention, not intended to limit the scope thereof. Many modifications of the above embodiments can be made without departing from the spirit of the present invention.

What is claimed is:

1. An alarm device for a computer lock, comprising a housing and a connecting plate disposed on the housing, an alarm system being installed in the housing, the connecting plate being formed with a perforation adapted to a locking bolt of a computer lock, such that a part of the locking bolt of the computer lock is passed through the perforation and inserted into a socket of the computer, whereby the alarm device is locked on the computer for sensing alien shake and emitting alarm sound, wherein a retractable/extensible sliding mechanism is disposed between the connecting plate and the housing, whereby the connecting plate is retractable into the housing or extensible from the housing.

2. The alarm device as claimed in claim 1, wherein the alarm system includes a sensing unit and an alarm sounding unit, whereby when the sensing unit senses a shake, the alarm sounding unit is activated to emit an alarm sound.

3. The alarm device as claimed in claim 1, wherein a press key is disposed on the housing of the alarm device for turning on/off the device.

* * * * *